US005220889A

United States Patent [19]

Ampferer et al.

[11] Patent Number: 5,220,889

[45] Date of Patent: Jun. 22, 1993

[54] INTAKE SYSTEM FOR A MULTI-CYLINDER INTERNAL-COMBUSTION ENGINE

[75] Inventors: Herbert Ampferer, Sachsenheim; Frank Ickinger, Pleidelsheim, both of Fed. Rep. of Germany

[73] Assignee: Dr. Ing. H.c.F. Porsche AG, Fed. Rep. of Germany

[21] Appl. No.: 887,150

[22] Filed: May 22, 1992

[30] Foreign Application Priority Data

May 22, 1992 [DE] Fed. Rep. of Germany ..... 4116653

[51] Int. Cl.[5] ..... F02M 35/10

[52] U.S. Cl. ..... 123/52 MC; 248/636; 285/49

[58] Field of Search ..... 123/52 M, 52 MV, 52 MC, 123/52 MB; 138/120; 248/636, 231.8; 277/186, 228; 285/49

[56] References Cited

U.S. PATENT DOCUMENTS 4,901,681 2/1990 Pozniak et al. ..... 123/52 MV

FOREIGN PATENT DOCUMENTS 3452608 3/1986 Fed. Rep. of Germany .
3641811 5/1988 Fed. Rep. of Germany .
3641812 2/1988 Fed. Rep. of Germany ... 123/52 M
3730817 6/1989 Fed. Rep. of Germany .
0082567 5/1984 Japan ..... 123/52 M

*Primary Examiner*—David A. Okonsky
*Attorney, Agent, or Firm*—Evenson, McKeown, Edwards & Lenahan

[57] ABSTRACT

An intake system which includes an intake distributor as well as intake pipe sockets leading to inlet ports in cylinder heads of an internal-combustion engine is held on the internal-combustion engine by means of first and second decoupling elements. For the mounting of the intake distributor, a plurality of tension devices are required which tension decoupling elements supported on a flange facing of the cylinder head. The forces which are transmitted in this case by the tension devices to the intake distributor may also be supported on the cylinder head by way of additional decoupling elements which are under compression due to the tension devices.

18 Claims, 6 Drawing Sheets

INTAKE SYSTEM FOR A MULTI-CYLINDER INTERNAL-COMBUSTION ENGINE

BACKGROUND AND SUMMARY OF THE INVENTION

This invention relates to an intake system for a multi-cylinder internal-combustion engine, which intake system is held above the cylinders on the internal-combustion engine and is decoupled from vibrations.

In the German Patent Document DE-36 41 811 C1, an intake system for a multi-cylinder internal-combustion engine is disclosed which is held on the cylinder head, being decoupled from vibrations, by means of elastic bearing elements. In this case, the bearing elements are subjected to compression by means of screwed connections between the intake system and supports on the cylinder head. During mounting, access is difficult to these screwed connections as well as to the connecting points between individual intake pipes of the intake system and inlet ports which are formed in the cylinder head and lead into a flange facing.

It is an object of the invention to develop an intake system in such a manner that a simple and fast mounting on the internal-combustion engine is ensured and, at the same time, the intake system is optimally decoupled from the internal-combustion engine with respect to vibrations.

This object is achieved by providing an arrangement comprising:

a plurality of engine cylinders, a cylinder head for the engine cylinders, an intake system for supplying combustion material to the cylinders through the cylinder head, and a holding arrangement for holding the intake system on the engine with decoupling of the intake system from engine vibrations, said holding arrangement including a first elastic decoupling element that is arranged under tension and serves to isolate the intake system from engine vibrations.

According to a first embodiment of the invention, the arrangement of a decoupling element which operates between the intake system and the cylinder head and is under tension and of another decoupling element which is arranged between the cylinder head and the individual intake pipes of the intake system and is under compression permit a mounting and demounting of the intake system in a few steps. For this purpose, it is only necessary to tighten tension devices which are accessible from above and penetrate the intake system perpendicularly whereby the intake system is decoupled with respect to vibrations by being elastically connected with the internal-combustion engine by way of the decoupling elements supported on the cylinder head. The forces which in this case are transmitted by the tension elements to the intake system are supported on the other decoupling elements which are placed between the cylinder heads and the intake system before the mounting of the intake system.

For the mounting and the demounting of the intake system, it is therefore only necessary to insert the additional decoupling elements before the placing of the intake system; the tightening of the tension device which may, for example, be constructed as a tension bolt, takes place subsequently.

Should accessibility of the additional decoupling element in the case of an in-line internal-combustion engine be difficult, for example, because of the assembling conditions, or should it be completely impossible in the case of a V-engine whose one-piece intake distributor of the intake system completely covers the inlet ports formed in the cylinder heads, this arrangement nevertheless permits a simple and fast mounting.

In an advantageous development of this embodiment of the invention, an intake pipe socket is arranged between the additional decoupling elements, which simultaneously act as a sealing device, and a flange facing. Between adjacent intake pipe sockets, the decoupling elements are supported on the flange facing by way of pipe-type fastening devices. As a result, no additional machined flange facing is required on the cylinder head for the supporting of these pipe-type fastening devices.

In a further development, the individual intake pipe sockets of one cylinder bank leading to each cylinder are constructed together with the pipe-type fastening devices in one piece as a bridge. In the case, for example, of an internal-combustion V-engine comprising four cylinders for each cylinder bank, these bridges are screwed together with the flange facing by means of a pipe-type fastening device arranged between the first and the second as well as by means of one arranged between the third and the fourth intake pipe socket. The decoupling elements are held on arms which are constructed in one piece with the pipe-type fastening devices and extend transversely with respect to the bridge into the direct proximity of the cylinder heads. As a result, the tension bolts can penetrate an exterior area of the intake distributor, such as an air collector, in a simple manner. In order to reach components which are arranged below the intake system in the V of the internal-combustion engine, only four tension bolts must be unscrewed, whereby the intake distributor can be lifted off.

According to a second embodiment of the invention, the intake system is held on the internal-combustion engine by means of dampers which reach around a pot-shaped housing which is detachably connected with the internal-combustion engine. In this housing, a rubber-elastic mass is arranged which is penetrated by a clamping sleeve equipped with a disk arranged on the end face and which is detachably connected with the intake system. This arrangement permits a simple and fast mounting and demounting of the intake system on the internal-combustion engine, while the vibrations are decoupled at the same time by means of the detachable connection between the clamping sleeve and the intake system.

In an advantageous development of this last-mentioned embodiment, the intake system and the clamping sleeves are connected with tension bolts which almost perpendicularly penetrate receiving devices constructed in the intake system. This ensures a good accessibility of the connection. A stop, which is arranged in the receiving device, limits the forces transmitted as a result of the screwed connection from the clamping sleeve to the rubber-elastic mass so that a desired characteristic of the damper can be adjusted.

Other objects, advantages and novel features of the present invention will become apparent from the following detailed description of the invention when considered in conjunction with the accompanying drawings.

DETAILED DESCRIPTION OF THE DRAWINGS

Figure 1:
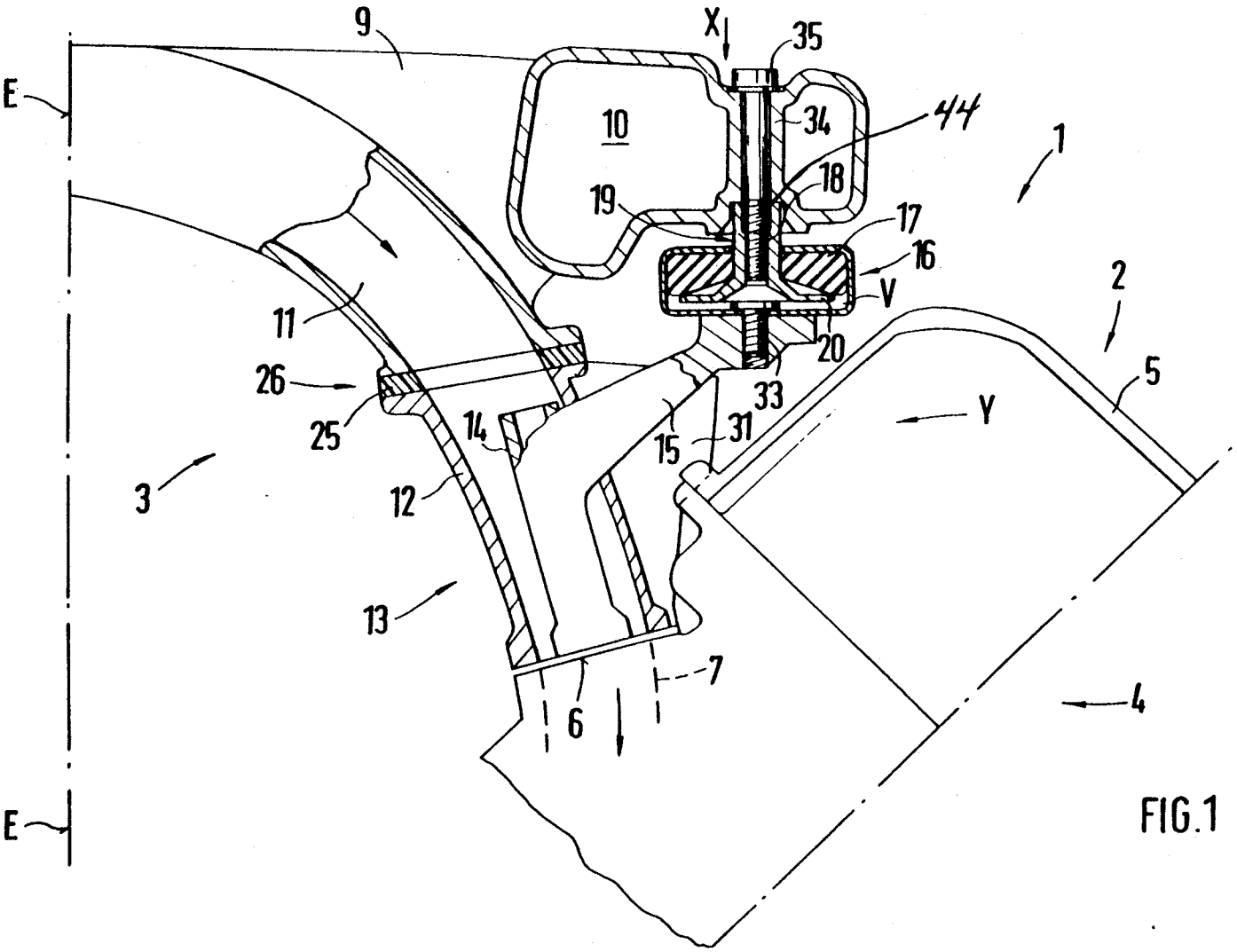
FIG. 1 is a sectional view of a first embodiment of an intake system constructed according to a preferred embodiment of the invention.
Figure 2:
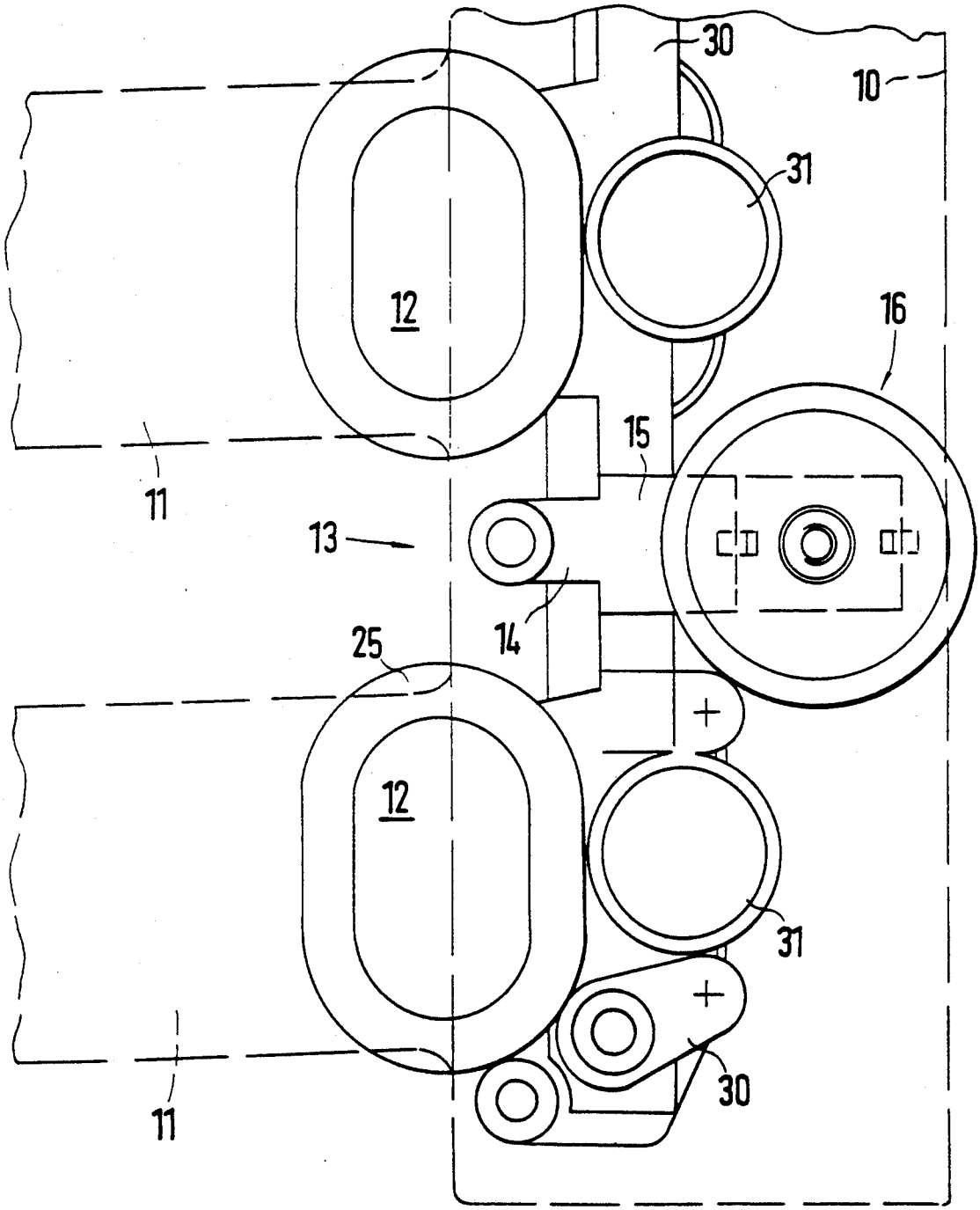
FIG. 2 is a top view according to FIG. 1 in the direction of the arrow X.
Figure 3:
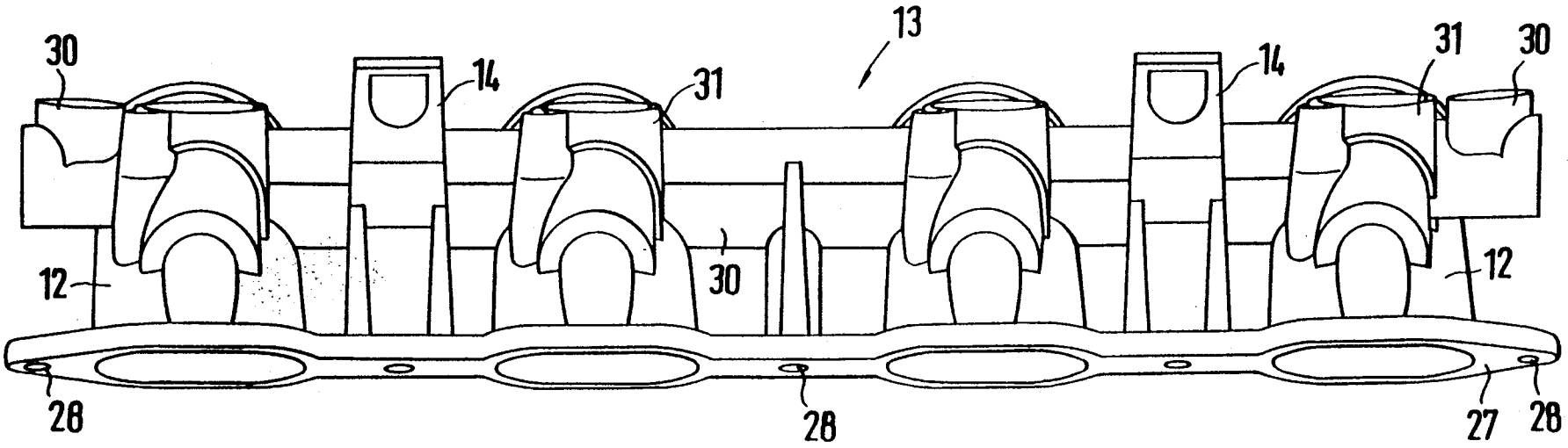
FIG. 3 is a view of a bridge of the intake system in the direction of the arrow Y according to FIG. 1.

As part of an internal-combustion V-engine, only one cylinder bank 2 comprising four cylinders is outlined in FIG. 1. Together with an intake system 3, the internal-combustion engine 1 is constructed symmetrically with respect to a perpendicularly extending plane E which receives a crankshaft that is not shown. The cylinder bank 2 has a cylinder head which is only outlined and has a cylinder head cover 5 and a flange facing 6 into which inlet ports 7 lead which are constructed in the cylinder head 4.

Above and between the cylinder banks 2, the intake system 3 is arranged which has an intake distributor 9, which comprises air collectors 10 and individual intake pipes 11, as well as intake pipe sockets arranged between the individual intake pipes 11 and the flange facings 6. The intake pipe sockets 12 of a cylinder bank 2 are constructed in one piece as a bridge 13 which forms a part of the intake system 3. Between the intake pipe sockets 12, the bridge 13 has two pipe-type fastening devices 14 which are constructed in one piece with it. Arms 15, which are cast onto the pipe-type fastening devices 14, extend transversely with respect to the plane E into the proximity of the cylinder heads 4.

At the geodetically highest point, the arms 15 carry pot-shaped decoupling elements which are detachably connected with them and are constructed as dampers 16. As a structural unit within a closed V-volume, the dampers 16 have a rubber-elastic mass 17 which is penetrated by a clamping sleeve 19 provided with an internal thread 18, the bottom closure of the clamping sleeve 19 being formed by a disk 20 which is in contact with the mass 17.

Between the mutually adjacent individual intake pipes 11 and the intake pipe sockets 12, additional decoupling elements are arranged which are constructed as a sealing device 25 and which for one cylinder bank 2 are connected with one another so that they are combined to form a sealing strip 26 and are secured against becoming off-center by means of noses which are not shown.

When the intake system 3 is first mounted on the internal-combustion engine 1, the bridges 13 are first screwed together with the flange facing 6 by means of the pipe-type fastening devices 14 as well as additional openings 28 constructed in a flange 27. The bridges 13 have fuel supply pipes 30 as well as injection valve receiving devices 31 which are not explained in detail. For the further mounting or for the demounting, for example, for servicing purposes, a sealing strip 26 is placed on each bridge 13. One damper 16 respectively is detachably connected with an arm 15 by means of a screw 33 which is accessible through the internal thread 18. Then the intake distributor 9 with the individual intake pipes 11 is placed on the sealing strips 26. By means of receiving devices 34 which are constructed perpendicularly in the air collectors 10, tension devices, which are constructed as tension bolts 35, are guided to the clamping sleeve 19 and are screwed together with its internal thread 18. A stop shoulder, which is constructed as a stop 44 in the receiving device 34, limits the upsetting of the mass 17 to an extent that is optimal for an effective decoupling.

The whole intake distributor 9 can be detached from the above-mentioned arrangement by the unscrewing of only four tension bolts 35. Instead of the tension bolts 35, quick-action tension elements may, for example, also be used which are equipped with a quarter-turn fastener and which, by means of a rotation of 180°, brace the intake distributor 9 and the damper 16 with one another.

Irrespective of the type of the tension devices, the decoupling elements are only under tension, in which case the tension forces transmitted from the damper 16 by means of the screw 33, the arm 15 and the pipe-type fastening devices 14, are supported in the flange facing 6 of the cylinder head 4. The forces which in this case are transmitted from the tension device to the intake distributor 9 are also supported on the flange facing 6 by way of the additional decoupling element, which is therefore under pressure, and by way of the intake pipe sockets 12.

Figure 4:
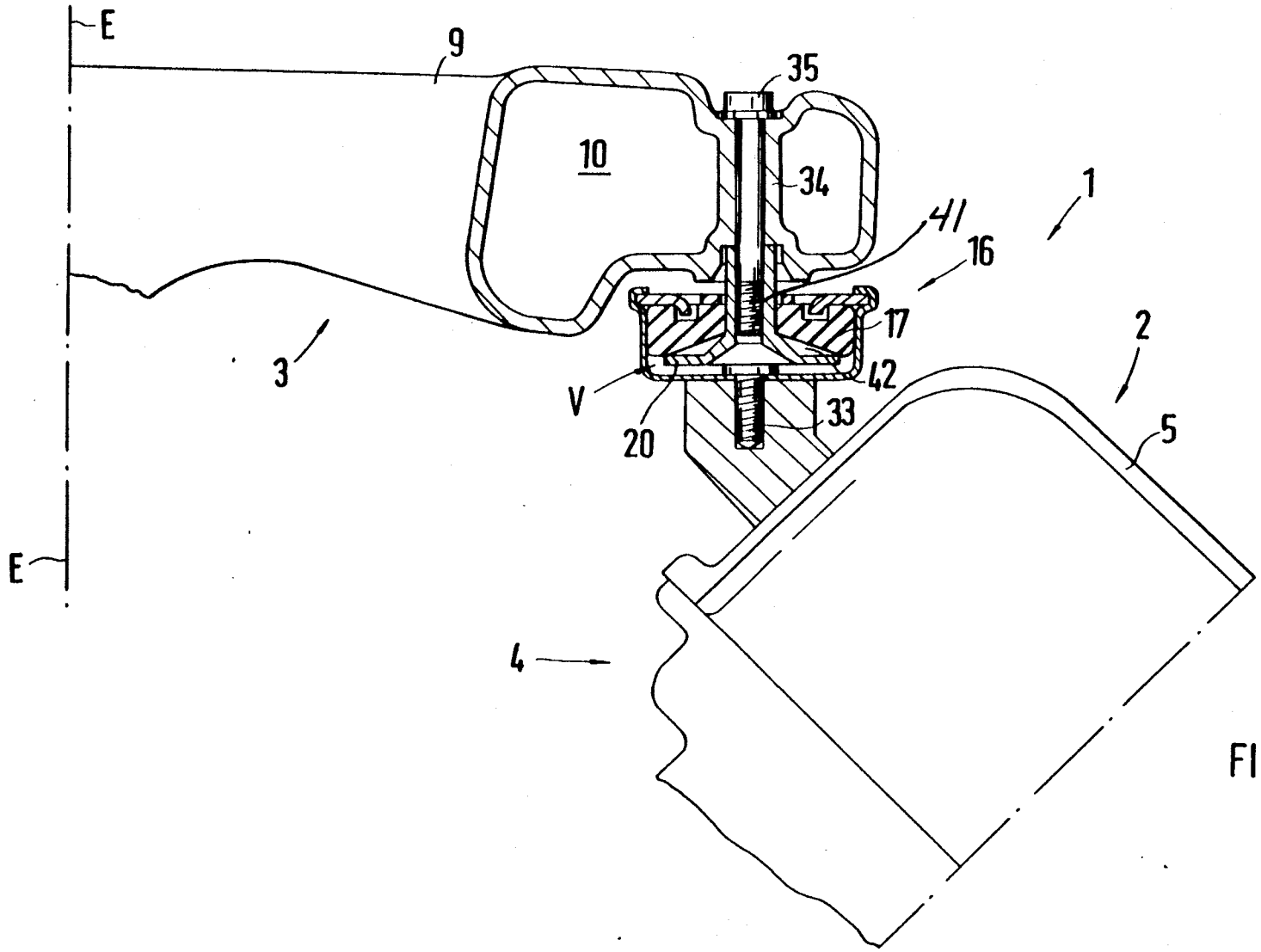
FIG. 4 is a sectional view of a second embodiment.
Figure 5:
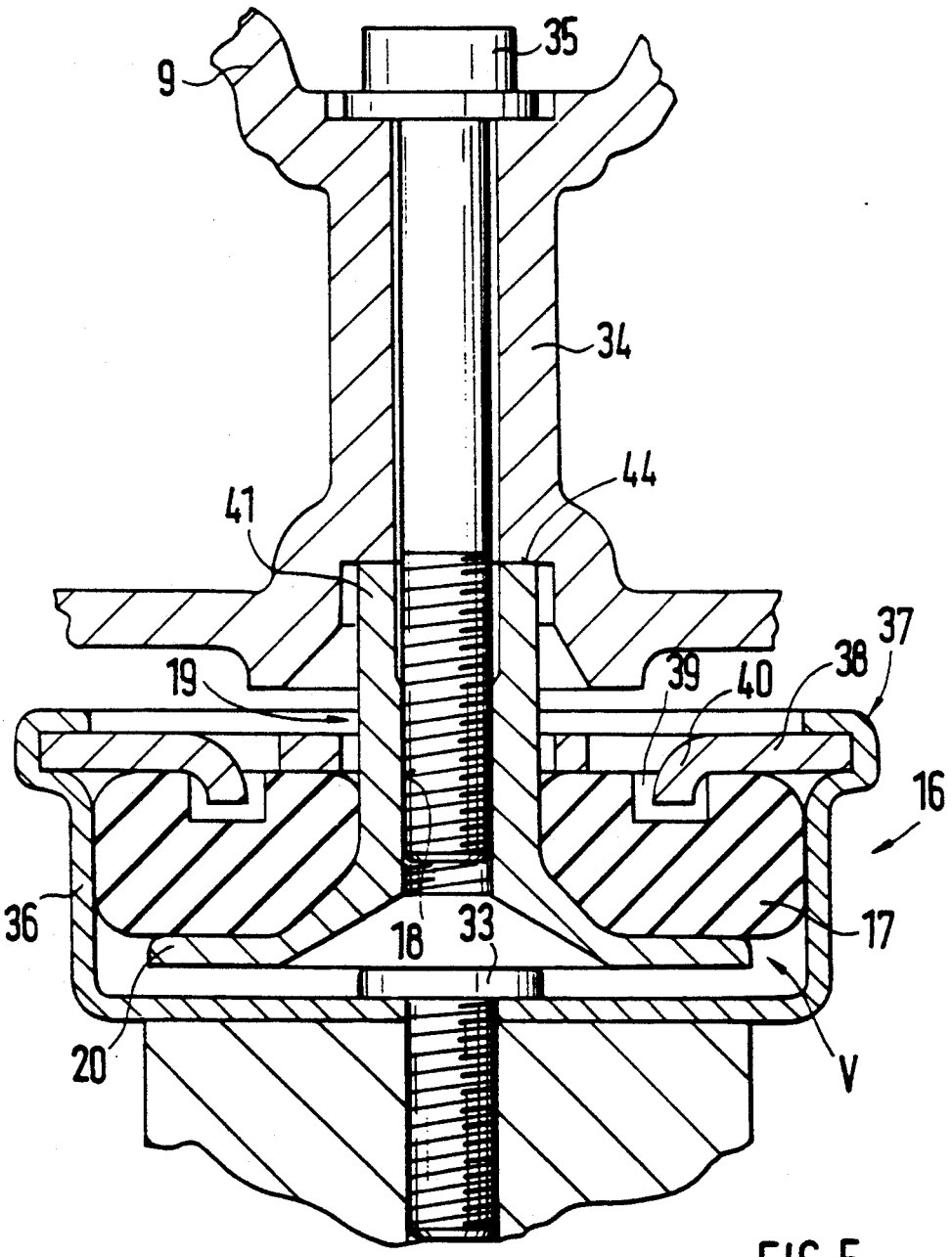
FIG. 5 is an enlarged sectional view of a damper of an intake system of the FIG. 4 embodiment.
Figure 6:
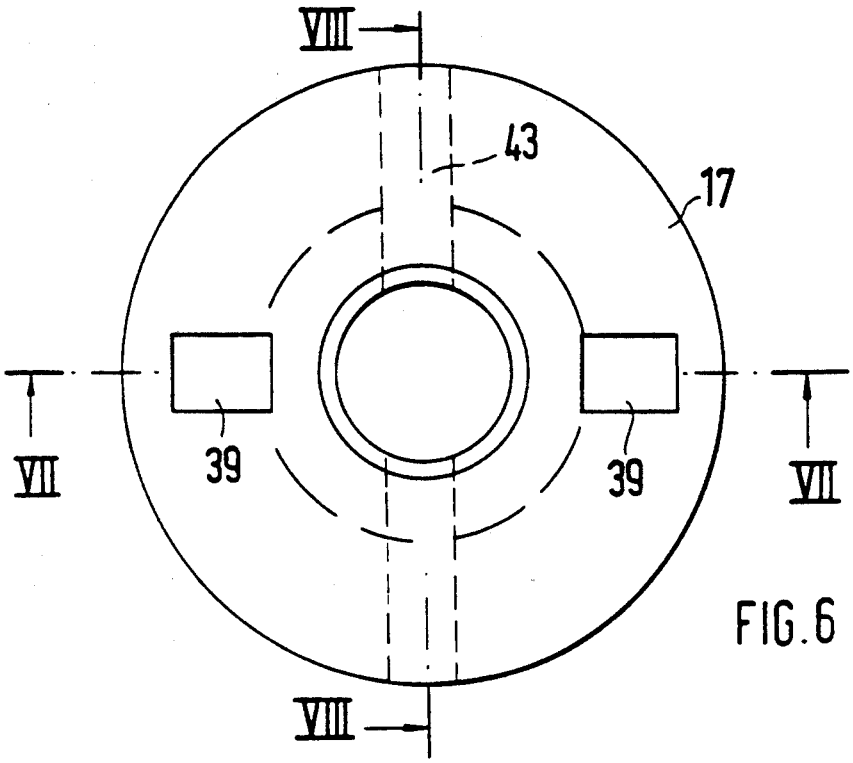
FIG. 6 is a top view of a component of the embodiment of FIGS. 4 and 5.
Figure 7:
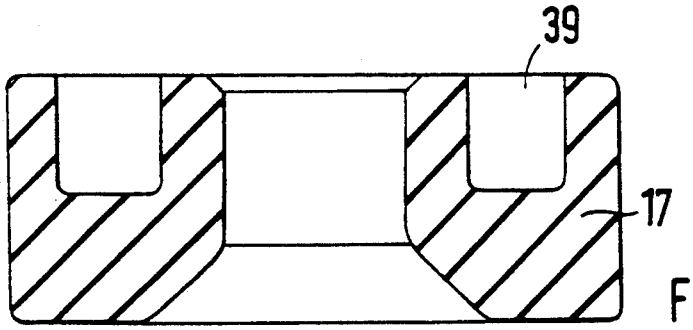
FIG. 7 is a sectional view along Line VII—VII of FIG. 6.
Figure 8:
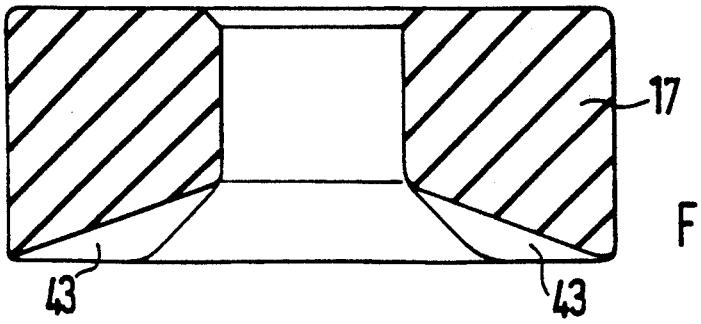
FIG. 8 is a sectional view along Line VIII—VIII of FIG. 6.

A second embodiment of the invention is illustrated in FIG. 4. Identical reference numbers characterize the same components in both embodiments. The intake system 3 is held on the internal-combustion engine 1 by means of dampers 16 in such a manner that it is decoupled from vibrations. The dampers 16 have a pot-shaped housing 36 which is detachably fastened on the internal-combustion engine 1 by means of screws 33. In the V-volume of the damper 16, the rubber-elastic mass 17 is arranged which is penetrated by the clamping sleeve 19 and which is supported on a cover 38 held in a bead 37 of the housing 36.

In the top side of the mass 17 facing the cover 38, recesses 39 are arranged into which punched-out tabs 40 of the cover 38 engage which form two claws.

Two sloping ribs 42, starting out from a sleeve body 41 receiving the internal thread 18, extend radially on the disk 20 and engage in corresponding recesses 43 of the mass 17.

With respect to the dampers 16, the mounting and demounting of the intake system takes place analogously to the first embodiment of the invention. Before the screwing-together, the mass 17 almost completely fills in the V-volume and in the process presses the disk 20 onto the bottom of the housing 36 opposite the cover 38. During the screwing-together, the clamping sleeve 19 is pulled out of the damper 16 and now compresses the mass 17 to an extent which determines a certain characteristic. This extent is limited by a stop shoulder which is constructed as a stop 44 in the receiving device 34. When the tension bolts 35 are loosened or tightened, a twisting of the clamping sleeve 19 with respect to the mass 17 or a twisting of the mass 17 with respect to the housing 36 is prevented by the ribs 42 which engage in recesses 43 and by the tabs 40 which engage in recesses 39. The supporting of the forces introduced by the tension bolts 35 into the air collector 10 takes place, for example, by way of intake pipes of the intake system 3 which are not shown.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A multi-cylinder internal-combustion engine arrangement comprising:

a plurality of engine cylinders;

a cylinder head for the engine cylinders;

an intake system for supplying combustion material to the cylinders through the cylinder head; and a holding arrangement for holding the intake system on the engine with decoupling of the intake system from engine vibrations, said holding arrangement including a first elastic decoupling element that is arranged under tension and serves to isolate the intake system from engine vibrations, said holding arrangement including:

a holding element which is connected directly with the cylinder head intermediate individual intake pipes of the intake system, said first elastic decoupling element being detachably attached to the holding element; and a second elastic decoupling element disposed under compression between a part of the intake system and the cylinder head.

2. An engine arrangement according to claim 1, wherein a plurality of said holding elements and said first and second elastic decoupling elements are provided.

3. An engine arrangement according to claim 2, wherein the intake system is perpendicularly penetrated by tension devices which are elastically connected under tension with respective first decoupling elements constructed as dampers which are supported on the cylinder head by respective ones of the holding elements, the second elastic decoupling elements being formed as sealing devices and being braceable under pressure between the intake system and the cylinder head by forces transmitted by the tension devices to the intake system.

4. An engine arrangement according to claim 3, wherein intake pipe sockets of the intake system are arranged between the sealing devices and a flange facing of the cylinder head, and wherein pipe-type fastening devices for the dampers are arranged between adjacent intake pipe sockets.

5. An engine arrangement according to claim 4, wherein the engine is an eight-cylinder internal-combustion engine with two cylinder banks, and wherein a bridge with four intake pipe sockets respectively is assigned to each cylinder bank, a pipe-type fastening device with an arm and a damper being in each case arranged between the first and the second as well as between the third and the fourth intake pipe socket.

6. An engine arrangement according to claim 4, wherein the pipe-type fastening devices and the intake pipe sockets of a cylinder bank of the internal-combustion engine are constructed in one piece as a bridge which is detachably held on the flange facing by means of the pipe-type fastening devices.

7. An engine arrangement according to claim 6, wherein the dampers are arranged on the holding elements constructed as arms in one piece with a pipe-type fastening device, the holding elements extending transversely with respect to the bridge directly to the cylinder head.

8. An engine arrangement according to claim 6, wherein the sealing devices of a cylinder bank which border on the individual intake pipes are constructed in one piece as sealing strips.

9. An engine arrangement according to claim 6, wherein the engine is an eight-cylinder internal-combustion engine with two cylinder banks, and wherein a bridge with four intake pipe sockets respectively is assigned to each cylinder bank, a pipe-type fastening device with an arm and a damper being in each case arranged between the first and the second as well as between the third and the fourth intake pipe socket.

10. An engine arrangement according to claim 7, wherein the engine is an eight-cylinder internal-combustion engine with two cylinder banks, and wherein a bridge with four intake pipe sockets respectively is assigned to each cylinder bank, a pipe-type fastening device with an arm and a damper being in each case arranged between the first and the second as well as between the third and the fourth intake pipe socket.

11. An engine arrangement according to claim, wherein the engine is an eight-cylinder internal-combustion engine with two cylinder banks, and wherein a bridge with four intake pipe sockets respectively is assigned to each cylinder bank, a pipe-type fastening device with an arm and a damper being in each case arranged between the first and the second as well as between the third and the fourth intake pipe socket.

12. A multi-cylinder internal-combustion engine arrangement comprising:

a plurality of engine cylinders;

a cylinder head for the engine cylinders;

an intake system for supplying combustion material to the cylinders through the cylinder head; and a holding arrangement for holding the intake system on the engine with decoupling of the intake system from engine vibrations, said holding arrangement including a first elastic decoupling element that is arranged under tension and serves to isolate the intake system from engine vibrations, wherein the first elastic decoupling element comprises a pot-type housing which is detachably connected with the internal-combustion engine and in which a rubber-elastic mass is arranged which is penetrated by a clamping sleeve which is equipped with a disk arranged on an end face and is detachably connected with the intake system.

13. An engine arrangement according to claim 12, wherein a plurality of said first elastic decoupling elements are provided.

14. An engine arrangement according to claim 12, wherein the intake system is perpendicularly penetrated by tension devices which engage in the clamping sleeves and are guided in receiving devices of the intake system.

15. An engine arrangement according to claim 14, wherein the receiving devices guiding the tension bolts have a stop on which the clamping sleeves come to rest after the screwing-together has taken place.

16. An engine arrangement according to claim 12, wherein ribs are arranged to extend radially sloping on the disk which starting from a sleeve body, and wherein the mass has corresponding recesses to engage with the ribs.

17. An engine arrangement according to claim 12, wherein a housing of the damper has a surrounding bead for receiving a cover penetrated by the clamping sleeve.

18. A multi-cylinder internal-combustion engine arrangement comprising:

a plurality of engine cylinders;

a cylinder head for the engine cylinders;

an intake system for supplying combustion material to the cylinders through the cylinder head; and a holding arrangement for holding the intake system on the engine with decoupling of the intake system from engine vibrations, said holding arrangement including a first elastic decoupling element that is arranged under tension and serves to isolate the intake system from engine vibrations, wherein the engine is an eight-cylinder internal-combustion engine with two cylinder banks, and wherein a bridge with four intake pipe sockets respectively is assigned to each cylinder bank, a pipe-type fastening device with an arm and a damper being in each case arranged between the first and the second as well as between the third and the fourth intake pipe socket.

* * * * *